US006564528B1

(12) United States Patent
Keegan

(10) Patent No.: US 6,564,528 B1
(45) Date of Patent: May 20, 2003

(54) METHOD AND APPARATUS FOR BAGGING POTATOES

(75) Inventor: Dennis Keegan, Twin Falls, ID (US)

(73) Assignee: Automation Manufacturing, LLC, Twin Falls, ID (US)

( * ) Notice: Subject to any disclaimer, the term of this patent is extended or adjusted under 35 U.S.C. 154(b) by 0 days.

(21) Appl. No.: 09/384,786

(22) Filed: Aug. 27, 1999

(51) Int. Cl.[7] ..... B65B 41/18

(52) U.S. Cl. ..... 53/171; 53/244; 53/245; 53/255; 53/260; 198/534

(58) Field of Search ..... 53/244, 245, 260, 53/540, 541, 255, 171; 198/534, 536

(56) References Cited

U.S. PATENT DOCUMENTS

| | | | | |
|---|---|---|---|---|
| 3,416,620 | A | | 12/1968 | McClusky |
| 3,621,629 | A | | 11/1971 | Wickersheim |
| 3,782,068 | A | | 1/1974 | Woyden et al. |
| 3,812,647 | A | * | 5/1974 | Bertling et al. |
| 3,977,483 | A | | 8/1976 | Greanias |
| 4,385,859 | A | * | 5/1983 | Goossens |
| 4,490,801 | A | | 12/1984 | Hagan et al. |
| 4,549,272 | A | | 10/1985 | Hagan et al. |
| 4,788,812 | A | | 12/1988 | Morita et al. |
| 4,800,703 | A | * | 1/1989 | Goodman |
| 4,864,801 | A | | 9/1989 | Fallas |
| 5,001,889 | A | | 3/1991 | Mueller |
| 5,009,058 | A | | 4/1991 | Ptaschek et al. |
| 5,022,218 | A | * | 6/1991 | Prakken |
| 5,117,614 | A | | 6/1992 | Johnsen |
| 5,127,212 | A | | 7/1992 | Johnsen et al. |
| 5,240,100 | A | * | 8/1993 | Elferink et al. |
| 5,555,709 | A | | 9/1996 | Savigny et al. |
| 5,911,667 | A | * | 6/1999 | Sanchis et al. |
| 6,047,527 | A | * | 4/2000 | Pazdernik et al. |

* cited by examiner

*Primary Examiner*—Eugene Kim
(74) *Attorney, Agent, or Firm*—Thorpe North & Western

(57) ABSTRACT

A method and apparatus for apparatus for bagging a plurality of filled bags, such as 5-lb., 10-lb. or 15-lb. potatoes, into a larger baler bag, such as a 50 or 60 lb. baler bag, has a chute for receiving the filled bags and defining a path of travel for the filled bags. A plurality of flaps are movably coupled to the chute at spaced apart locations along the length of the chute to define a plurality of sequential stops. The flaps move between a first stop position extending into the path of travel of the filled bags, and a second pass position extending out of the path of travel of the filled bags. The plurality of flaps move sequentially from the upper end of the chute to the lower end between the first stop position and the second pass position, such that the filled bags are sequentially lowered from one flap to another. A plurality of baler bag heads have pivoting flap members secured to a collar for holding the baler bags between the flaps and lips on the collar. The baler bag heads are disposed on a conveyor and sequentially positioned at different stages for receiving baler bags, filling the baler bags, and discharging the baler bags.

17 Claims, 10 Drawing Sheets

METHOD AND APPARATUS FOR BAGGING POTATOES

BACKGROUND OF THE INVENTION

1. The Field of the Invention

The present invention relates generally to a method and apparatus for bagging a plurality of filled bags, such as bags of potatoes, into a larger baler bag. More particularly, the present invention relates to a method and apparatus in which the filled bags are bagged in a baler bag using a chute with a plurality of spaced apart flaps to sequentially lower the filled bags to prevent bruising, and in which a bag head supports and holds open the baler bags.

2. The Background Art

Potatoes are typically bagged in 5-lb., 10-lb. and 15-lb. bags for retail sale to consumers in grocery stores and supermarkets. In addition, the 5-lb., 10-lb. and 15-lb. bags are typically bagged themselves in larger 50-lb. baler bags which hold 10 of the 5-lb. bags or five of the 10-lb. bags, or 60-lb. baler bags which hold four of the 15-lb. bags, for wholesale to the stores and markets.

The bagging process initially involves machines to sort and weigh the potatoes into groups which weigh either 5 lbs., 10 lbs. or 15 lbs. The groups of potatoes are then bagged in the 5-lb., 10-lb. or 15-lb. bags. The 5-lb., 10-lb. and 15-lb. bags are then packaged and sealed into the 50 lb. or 60 lb. baler bags.

During the baling process it is desirable to gently handle the potatoes so as to prevent bruising or other undesirable effects. One disadvantage with typical bagging systems is that they rely on gravity to accomplish the bagging. For example, potatoes are usually elevated and then dropped into buckets or onto the scales for weighing. Dropping the potatoes increases the risk of bruising the potatoes. In addition, the 5-lb., 10-lb. and 15-lb. bags are usually elevated and then dropped into the baler bags. Dropping the heavier bags further increases the risk that the 5-lb., 10-lb. or 15-lb. of potatoes will land on and bruise a lower potato.

Another disadvantage of typical prior art bagging systems is that the collection of 5-lb., 10-lb. or 15 lb. bags usually must wait for a baler bag to be opened and positioned to receive the 5-lb., 10-lb. and 15-lb. bags, thus slowing the process. For example, 10 of the 5-lb. bags, five of the 10-lb. bags, or four of the 15-lb. bags, are usually accumulated at an elevated point. Collecting the requisite bags is typically accomplished quickly. Preparing the baler bag to receive the collection is typically a slower process. The previous baler bag with the previous collection of bagged potatoes must first be removed. A new baler bag must then be opened, positioned, and secured or supported before the current collection of bagged potatoes may be received into the baler bag.

It is also desirable to securely hold the baler bag in an upright and open configuration while receiving the bagged potatoes. The weight of the 50 or 60 lbs. of potatoes tends to weigh the baler bag and pull it away or down. Another disadvantage with the typical prior art bagging systems is the difficulty in securing or supporting the baler bag under the bagged potatoes while the baler bag receives the bagged potatoes. As indicated above, the 5-lb., 10-lb. and 15-lb. bags are typically dropped into the baler bag. The bags sometimes catch the edge of the baler bag, causing the baler bag to rip and spill the bagged potatoes on the ground.

Therefore, it would be advantageous to develop a method and apparatus capable of more efficiently and quickly bagging potatoes, while more carefully and gently handling the potatoes. It would also be advantageous to develop a method and apparatus capable of baling the bags of potatoes without bruising them. It would also be advantageous to develop a method and apparatus capable of more efficiently opening, positioning, and securing a baling bag for receiving the bagged potatoes. It would also be advantageous to develop a method and apparatus for securely holding a baler bag in an upright and open configuration for receiving bagged potatoes.

OBJECTS AND SUMMARY OF THE INVENTION

It is therefore an object of the present invention to provide a method and apparatus for efficiently and carefully baling a plurality of bagged potatoes into a baler bag.

It is another object of the present invention to provide such a method and apparatus for efficiently opening, positioning and securing a baler bag for receiving the plurality of bagged potatoes.

It is yet another object of the present invention to provide such a method and apparatus for securely supporting the baler bag in an upright and open configuration for receiving the bagged potatoes.

The above objects and others not specifically recited are realized in a specific illustrative embodiment of an apparatus for bagging a plurality of filled bags, such as 5-lb., 10-lb. or 15-lb. potato bags, into a larger baler bag, such as a 50 or 60 lb. baler bag. The apparatus includes a chute for receiving the filled bags and defining a path of travel for the filled bags. Advantageously, a plurality of flaps are movably coupled to the chute at spaced apart locations along the length of the chute and defining a plurality of sequential stops. The flaps move between a first stop position and a second pass position.

In the first stop position, the flaps extend transversely to the chute and into the path of travel of the filled bags to stop the filled bags from continued travel along the chute. In the second pass position, the flaps extend out of the path of travel of the filled bags to allow the filled bags to continue traveling along the chute. The plurality of flaps move sequentially in order from the upper end of the chute to the lower end between the first stop position to the second pass position. Thus, the filled bags are advantageously sequentially lowered from one flap-to another. Therefore, the bags are only lowered through a plurality of distances relative to their size, rather than a single distance relative to the size of the group, to prevent bruising.

In accordance with one aspect of the present invention, the plurality of flaps divide the chute into a plurality of individual compartments. The plurality of flaps are spaced apart a distance such that each of the individual compartments are sized to receive at least one of the filled bags.

For example, a first upper flap is located closer to the upper end of the chute than the remaining flaps and defines a first stop at a first height. A second flap is spaced apart from the first flap a distance generally equal to the size of at least one of the filled bags. Thus, an upper surface of an upper filled bag is disposed generally at the same height as the first height of the first stop when disposed on the second flap. Therefore, the filled bags entering the chute generally fall the same distance from the upper end of the chute to the first stop or upper surface of the upper filled bag.

Preferably, a sensor is located proximal to the upper end of the chute which senses the filled bags entering the chute and produces a sensor signal. A controller is responsive to the sensor signal and producing a control signal. A plurality of actuators are each coupled to a different flap and are responsive to the control signal to move the flaps.

In accordance with another aspect of the present invention, at least one baler bag head is disposed at a lower end of the chute for supporting the bale bag in an open configuration for receiving the filled bags from the chute. A collar movably engages a support frame and defines an opening through which the filled bags pass into the baler bag. First and second lips are located at opposite sides of the opening. A plurality of pivoting plate members are pivotally coupled to the collar at opposite sides of the opening and have lower ends extending to different locations opposing the lips. Thus, opposite sides of the baler bag may be grasped between the lips and lower ends of the pivoting plate members. Upper ends of the pivoting plate members engage the support frame such that the pivoting plate members pivot as the collar moves. The pivoting plate members pivot between a first open position and a second closed position. In the first open position, the lower ends of the pivoting plate members pivot away from the lips to remove and position baler bags between the lips and lower ends. In the second closed position, the lower ends of the pivoting plate members pivot towards the lips to grip the baler bags between the lower ends of the pivot members and the lips. Therefore, the baler bags are secured and supported in an open configuration to receive the filled bags.

In accordance with another aspect of the present invention, a plurality of baler bag heads are disposed on a baler bag wheel for sequentially position the baler bag heads at a plurality of different stations. At a first station, baler bags are hung from the baler bag heads. A bag hanging mechanism positions the upper end of the baler bags at the heads for being grasped by the lips and pivoting plate members. At a second station located beneath the chute, bags of potatoes are received from the chute into the baler bags. At a third station, baler bags are removed from the heads. Therefore, one baler bag may be filled while another baler bag is opened and secured to another head, rather than of a single head, to improve efficiency.

In accordance with another aspect of the present invention, a take-away conveyor conveys baler bags away from the baler bag wheel. A first, horizontally-oriented conveyor has a horizontal surface configured for receiving the baler bags thereon. A second, vertically-oriented conveyor extends along the first conveyor and having a plurality of spaced-apart partitions extending therefrom for receiving the baler bags therebetween. Therefore, the baler bags are secured in an upright orientation for a subsequent sealing operation.

A method for bagging a plurality of filled bags into a larger baler bag includes elevating the plurality of filled bags to a predetermined height. The filled bags are sequentially lowered along a path of travel through a series of discrete vertical stages using a chute having a plurality of movable flaps spaced along the length of the chute defining the series of stages. A baler bag is positioned beneath the filled bags and opened to receive the filled bags. The filled bags are lowered into the baler bag.

For example, a first filled bag is disposed onto a first flap. The first flap is moved to lower the first filled bag onto a second flap located at an elevation lower than the first flap. A second filled bag is disposed onto the first filled bag. Again, the filled bags advantageously are lowered through a plurality of discrete distances relative to their size to prevent bruising, which is more likely to occur by lowering the filled bags a greater distance.

In accordance with one aspect of the present invention, a baler bag is opened, positioned, and supported on a bale bag head simultaneously with elevating and/or sequentially lowering the filled bags, and at a location different from the location beneath the chute. Therefore, while one baler bag is being filled, another baler bag can be prepared.

In accordance with another aspect of the present invention, the baler bag is immediately displaced from the location beneath the chute after the filled bags have been lowered into the baler bag, and another baler bag is simultaneously positioned beneath the chute.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
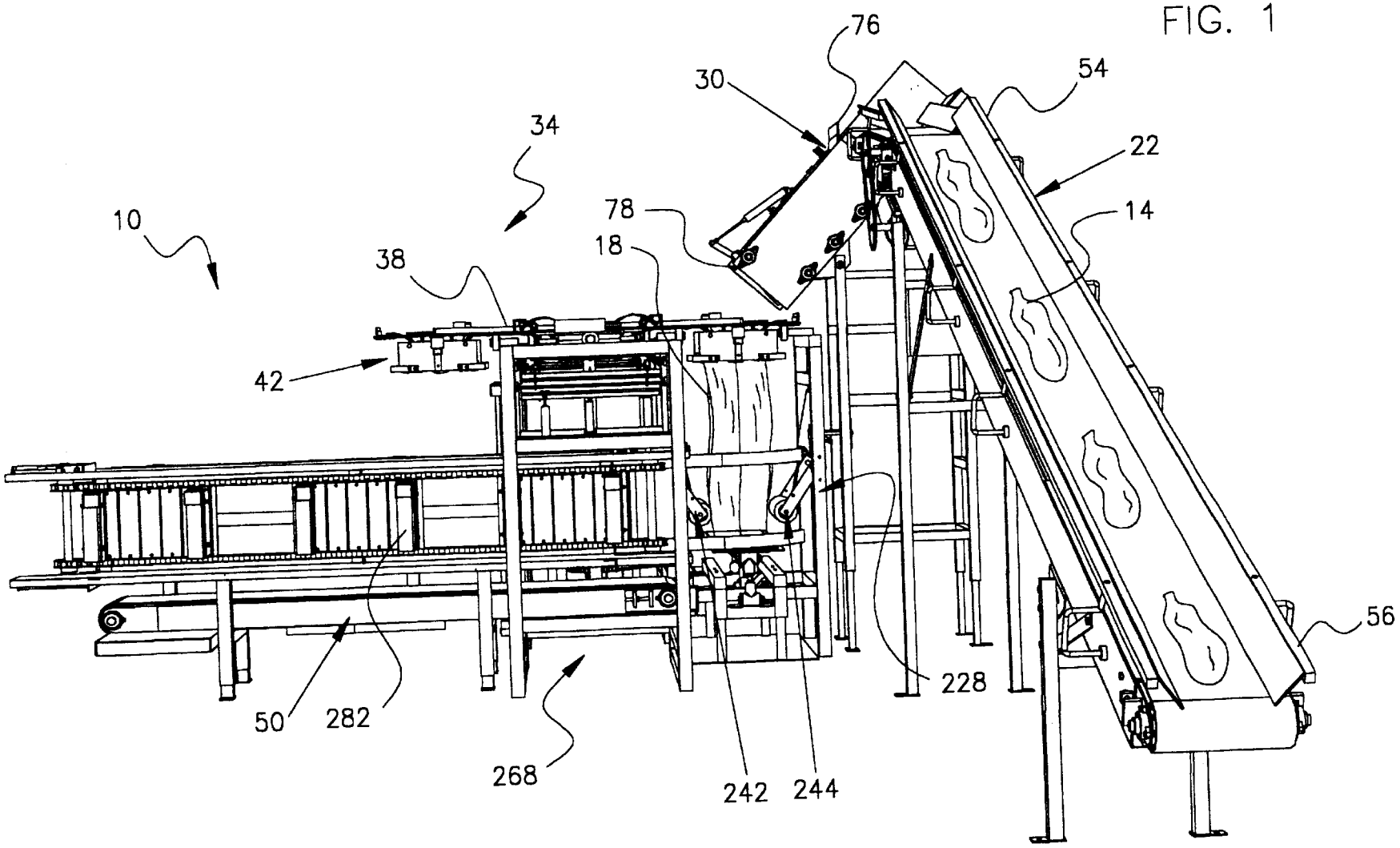
FIGS. 1 and 2 are different side views of a preferred embodiment of an apparatus for bagging bags of potatoes into a baler bag of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
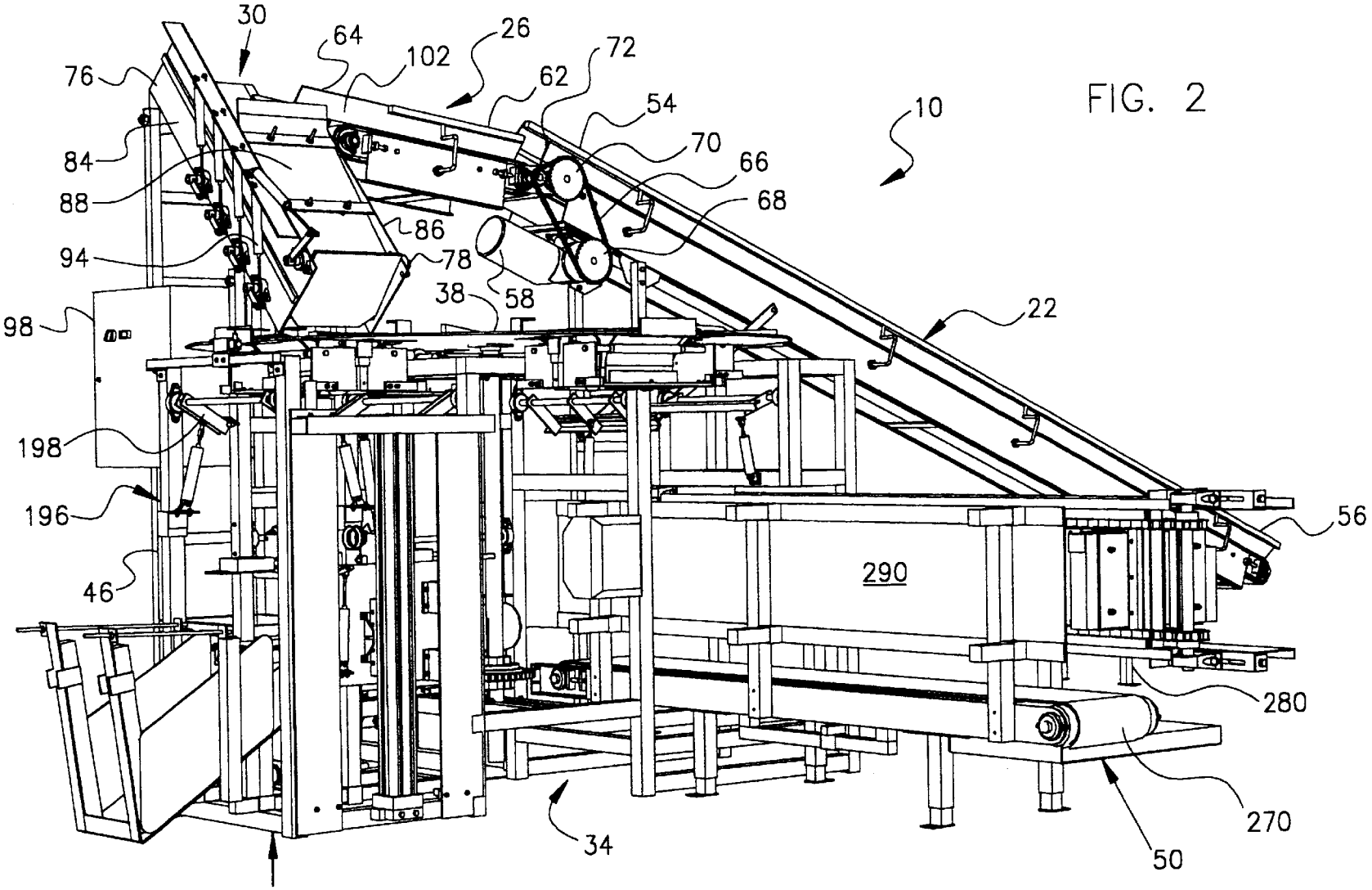

As illustrated in FIGS. 1–2, an apparatus, indicated generally at 10, in accordance with the present invention is shown for bagging a plurality of bags 14 (FIG. 1) filled with potatoes into a larger baler bag 18 (FIG. 1) in a manner to prevent bruising of the potatoes and more efficiently as part of a potato bagging operation. Although the present invention is described and illustrated herein with particular reference to a potato bagging operation, it is of course understood that the apparatus 10 may be used for bagging a plurality of bags 14 (FIG. 1) filled with other items, such as other vegetables or fruits, into the baler bags 18 (FIG. 1). It is also understood that the plurality of filled bags 14 may be "bagged" in boxes, as well as baler bags 18, as is known in the art. Thus, the term "baler bags" is intended to include boxes for receiving the filled bags 14.

Generally, the apparatus 10 preferably includes: an in-feed conveyer 22 for conveying and elevating the bags 14 of potatoes; a speed-up conveyer 26 (FIG. 2) for separating the bags 14; a bag collection chute 30 for receiving the bags 14 from the speed-up conveyer 26 and accumulating the bags 14; a baler bag handling apparatus, indicated generally at 34, including a baler bag rotating wheel 38 for rotating baler bags 18; a plurality of baler bag heads 42 for supporting baler bags 18; a baler bag in-feed 46 (FIG. 2) for opening and positioning baler bags 18 at the heads 42; and a take-away conveyer 50 for conveying baler bags 18 from the baler bag conveyer 38. The apparatus 10 gathers and orients a predetermined number of the filled bags 14; opens and supports the baler bags 18; and bags the filled bags 14 into the baler bags 18. The potatoes are weighed, sorted, and bagged into the bags 14 with another apparatus (not shown).

The in-feed conveyer 22 is an elongated inclined conveyer for conveying the bags 14 of potatoes to an elevated location. The conveyer 22 has opposite upper and lower ends 54 and 56. The lower end 56 is located and configured for receiving the bags 14 of potatoes, usually from another conveyer or from the other potato bagging apparatus (not shown). The upper end 54 of the conveyer 22 is located at a higher elevation than the lower end 56 such that gravity is used to bag the bags 14 of potatoes into the baler bags 18, and such that the bags 14 of potatoes can be bagged in vertically oriented or upright baler bags 18. The conveyer 22 has a continuous belt looped around rollers at the opposite ends 54 and 56 of the conveyer 22. A motor or driver 58 (FIG. 2) is operatively coupled to one of the rollers for turning the belt. The motor 58 may drive the belt continuously, such that the conveyer 22 continuously conveys the bags 14 of potatoes, or may operate intermittently to selectively convey the bags 14 of potatoes.

The speed-up conveyer 26 also is an elongated conveyer which operates or conveys at a faster speed than the in-feed conveyer 22 in order to separate the bags 14 of potatoes. The speed up conveyer 26 similarly may have a continuous belt looped around a pair of roller at opposite ends of the conveyer. By operating at a faster speed, the speed-up conveyor 26 separates the bags 14 received from the in-feed conveyor 22 so that the bags 14 may be sensed or counted, as discussed more fully before. The speed-up conveyer 26 may be disposed generally horizontally and has a receiving end 62 located proximal to the upper end 54 of the in-feed conveyer 22 for receiving the bags of potatoes 14 from the in-feed conveyer 22. The speed-up conveyer 26 also has an opposite discharge end 64.

Referring to FIG. 2, the motor 58 may be used to drive both the in-feed conveyer 22 and the speed-up conveyer 26 through a drive chain or belt looped around gears or pulleys associated with the motor and rollers. The drive chain or belt 66 may be looped around a motor pulley or gear 68, an in-feed pulley or gear 70, and a speed-up pulley or gear 72. The gears or pulleys 68, 70 and 72 may be sized differently to control the speed of the conveyers 22 and 26. Preferably, the speed-up pulley 72 is sized smaller than the motor pulley 68 and in-feed pulley 70, causing the speed-up conveyer 26 to move faster than the in-feed conveyer 22. It is of course understood that different motors may be used to drive the in-feed conveyor and the speed-up conveyor.

Referring again to FIGS. 1 and 2, the bag collection chute 30 preferably is a vertically inclined chute for receiving the bags 14 of potatoes from the speed-up conveyer 26. The chute 30 may be oriented vertically, or at an inclined angle with respect to the ground, as shown. In addition, the chute 30 may be configured for receiving the bags 14 of potatoes from the speed-up conveyer 26, as shown, or may be located to receive the bags 14 of potatoes directly from the in-feed conveyer 22. The chute 30 defines a path of travel for the bags 14 of potatoes.

The chute 30 has an open upper end 76 located proximal to the discharge end 64 of the speed-up conveyer 26, as shown, or the upper end 54 of the in-feed conveyer 22. The chute 30 also has an opposite lower end 78 located at a lower elevation than the upper end 68. Again, the chute 30 is oriented vertically or at a vertical incline such that the bags 14 of potatoes may be fed by gravity through the chute 30 and into the vertically oriented baler bags 18.

Figure 3:
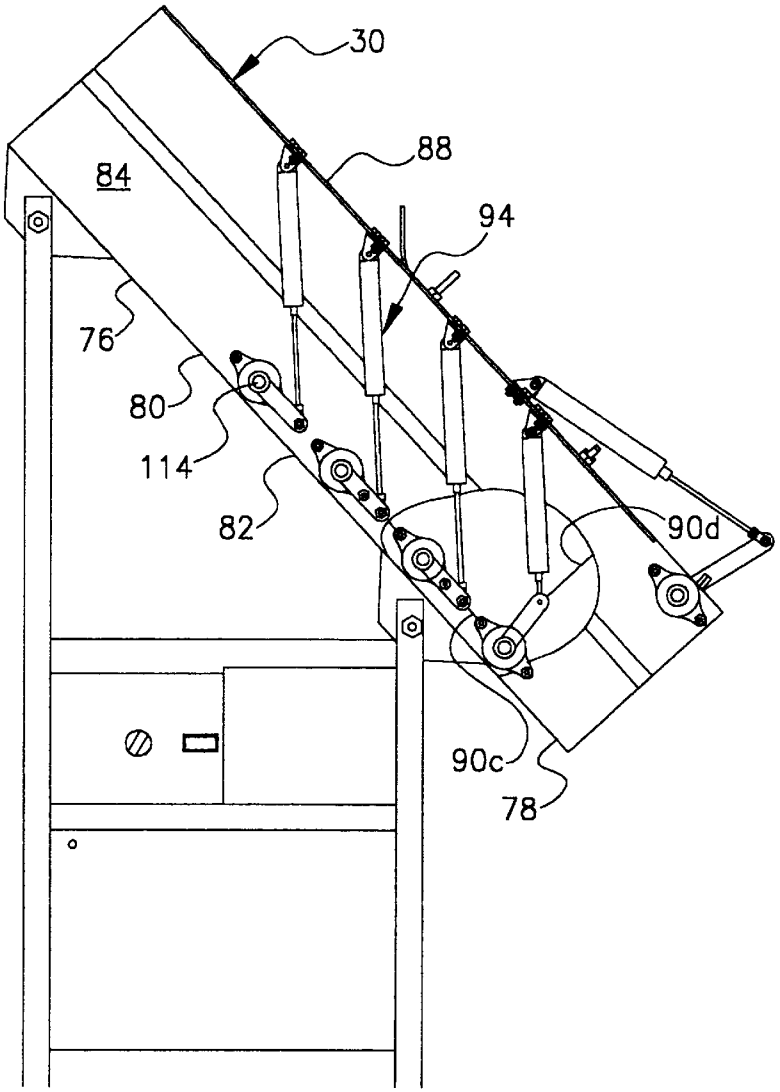
FIG. 3 is a side view of a preferred embodiment of the apparatus for bagging bags of potatoes into a baler bag of the present invention.

Referring to FIG. 3, the chute 30 preferably has a chute wall 80 defining and substantially surrounding a hollow interior through which the bags 14 of potatoes pass. Again, the chute 30 may be vertically inclined forming a slide including a bottom wall 82 along which the bags 14 of potatoes slide as they pass through the chute 30. Thus, the bags 14 preferably slide, rather than fall, to further prevent bruising. In addition, the chute 30 preferably includes opposing side walls 84 and 86 (FIG. 2) and a top wall 88. The chute also preferably has a length sized to receive a pre-selected number of the bags 14 of potatoes. As discussed above, it is desirable to bag a quantity of five of the 10-lb. bags 14 of potatoes into the baler bag 18, or a quantity of 10 of the 5-lb. bags 14 of potatoes into the baler bag 18, or a quantity of four of the 15-lb. bags into the baler bag 18. Thus, the chute 30 preferably has a length sized to receive five 10-lb. bags of potatoes in a side-by-side relationship, or 10 of the 5-lb. bags of potatoes grouped in pairs in a side-by-side relationship, or four 15-lbs. bags of potatoes in a side-by-side relationship.

Figure 4A:
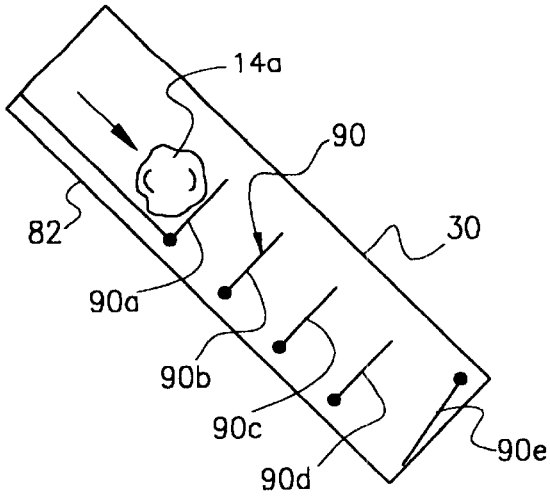
FIGS. 4*a*–4*f* are schematic views of the preferred embodiment of the apparatus for bagging bags of potatoes into a baler bag of the present invention.
Figure 4B:
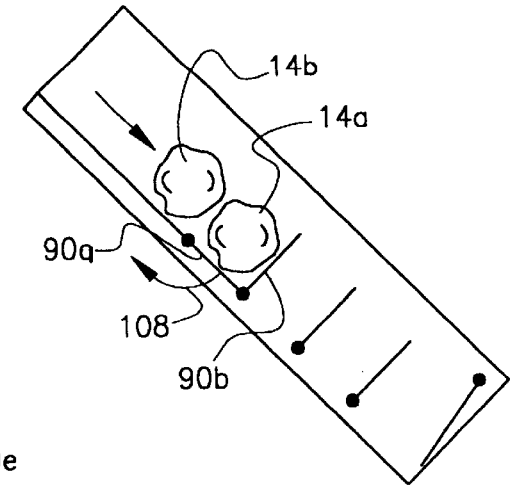
Figure 4C:
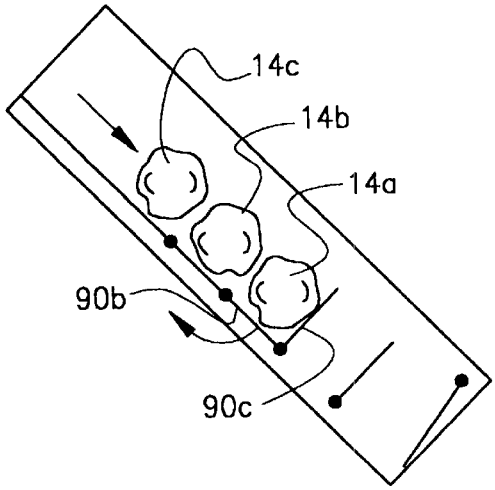
Figure 4D:
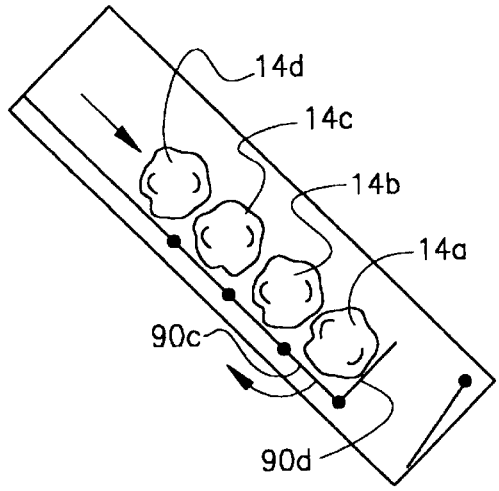
Figure 4E:
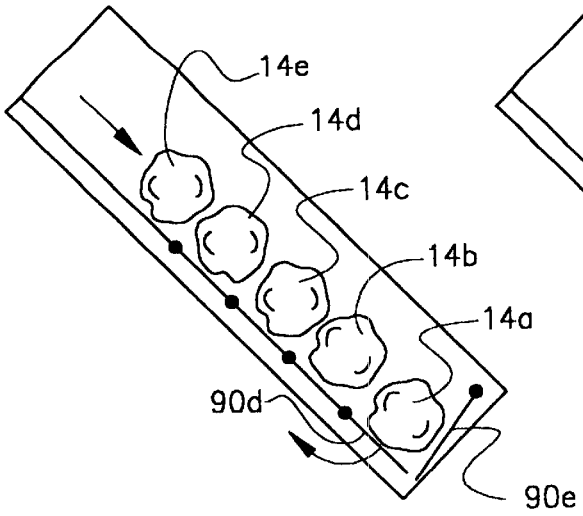
Figure 4F:
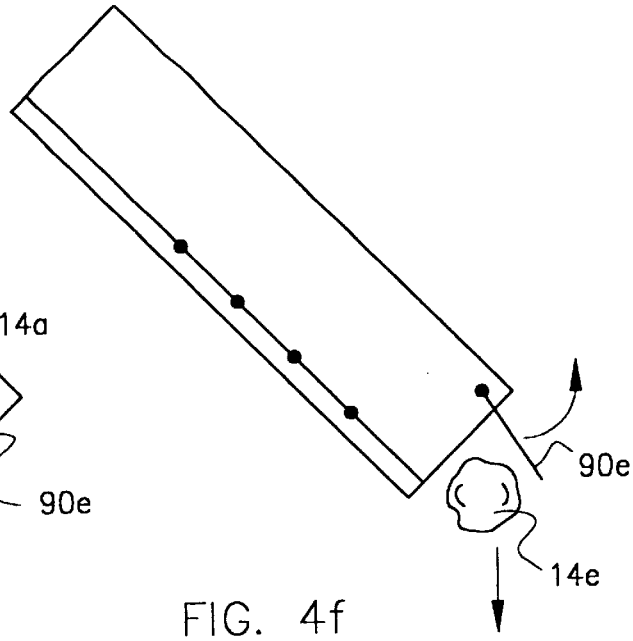

Referring now to FIGS. 3 and 4*a*–4*f*, a plurality of spaced-apart flaps 90 advantageously are movably coupled to the chute 30. The flaps 90 are disposed at spaced-apart locations along the length of the chute 30, and define a plurality of sequential vertical stops. The flaps 90 move between a first stop position and a second pass position. In the first stop position, the flaps 90 extend transversely to the chute 30 and into the path of travel of the bags 14 to stop the bags from continued travel along the chute 30, as shown in FIG. 4*a*. In the second pass position, the flaps 90 extend out of the path of travel of the bags 14 to allow the bags 14 to continue travel along the chute 30, as shown in FIG. 4*f*. Preferably, the flaps 90 extend parallel with the chute 30 and path of travel in the second pass position, as shown.

Preferably, the flaps 90 are pivotally coupled to the chute 30 and pivot between the first stop position and the second pass position as discussed more fully below. A plurality of actuators 94 (FIG. 3) are coupled to and between the flaps 90 and the chute 30 for moving or pivoting the flaps 90 between the first and second positions. Referring to FIG. 2, the actuators 94 are operatively coupled to a controller 98. The controller 98 may include any type of controller for controlling the actuators 94, and may include any type of microprocessor, hard-wire electronics, or mechanical logic components. The controller 98 produces control signals, which may be electrical, hydraulic, pneumatic, etc. The actuators 94 are responsive to the control signals to pivot or otherwise move the flaps 90.

Again referring to FIG. 2, a sensor 102 is located proximal the upper end of the chute 30 and senses the passage of bags 14 of potatoes entering the chute 30. The sensor 102 may be located at the discharge end 64 of the speed-up conveyer 26, as shown, or the upper end 54 of the in-feed conveyer 22. The sensor is operatively coupled to the controller 98 and produces a sensor signal which is sent to the controller. The controller 98 is responsive to the sensor signal. The sensor 102 senses the passage of a filled bag 14 entering the chute 30 and produces a sensor signal received by the controller 98. The controller 98 produces a control signal received by the appropriate actuator 94. The appropriate actuator 94 operates in response to the control signal to pivot the corresponding flap 90. Thus, as filled bags 14 sequentially enter the chute 30, the flaps 90 are sequentially pivoted from the first to the second position in order to sequentially lower the bags 14 as they enter the chute 30.

Referring again to FIGS. 3 and 4*a*–4*f*, as indicated above, the apparatus 10 as illustrated herein is specifically configured for bagging a quantity of five 10-lb. bags 14 of potatoes into the baler bag 18, or a quantity of 10 5-lb. bags, or a quantity of four 15-lb. bags. Thus, the plurality of flaps 90 preferably include at least five flaps such as first, second, third, fourth and fifth flaps 90*a*, 90*b*, 90*c*, 90*d* and 90*f*. The plurality of flaps 90 extend into the chute 30 defining a plurality of stops, and dividing the chute 30 into a plurality of individual compartments. The flaps 90 are spaced apart a distance equal to the size of at least one bag 14, and each of the individual compartments are sized to receive at least one of the bags 14.

The plurality of flaps 90 move from the first stop position to the second pass position sequentially in order from the upper end 76 to the lower end 78, or from the first flap 90*a* to the last flap 90*f*. Thus, the bags 14 are sequentially lowered from one flap to another in the chute. Therefore, the filled bags 14 are sequentially lowered through a plurality of discrete distances sized relative to the size of the bag 14, as opposed to a single distance sized relative to the entire group of bags 14, to prevent bruising.

The first flap 90*a* is an upper flap and is located closer to the upper end 76 of the chute 30 than the remaining flaps and defines a first stop at a first height or elevation, or first depth, within the chute. Referring to FIG. 4*a*, the flaps 90 are initially positioned in the first stop position. A first bag 14*a* of potatoes is received within the chute 30 and drops or slides down the bottom wall 82 to the first flap 90*a*. Referring to FIG. 4*b*, the first flap 90*a* then moves or pivots as indicated by arrow 108 to the second pass position allowing the first bag 14*a* of potatoes to fall or slide to the second flap 90*b*. Because the first and second flaps 90*a* and 90*b* are spaced apart a distance sized relative to the bags 14, the first bag 14*a* only slides a distance generally equal to its size. An upper side of the first bag 14*a* is now disposed generally at the same height as the first flap 90*a* in the first stop position. Thus, although the first flap 90*a* has pivoted to the second pass position, the upper side of the first bag 14*a* now disposed approximately at the same location as the first flap 90*a* in the first stop position.

A second bag 14*b* enters the chute and falls or slides until it abuts the first bag 14*a*. Thus, the first and second bags 14*a* and 14*b* fall or slide roughly the same distance in the chute 30 before abutting a flap 90 or another bag 14. Referring to FIG. 4*c*–*e*, this process repeats for the second, third, fourth, and fifth flaps 90*b*, 90*c*, 90*d*, and 90*f*, and the third through fifth bags, 14*c*, 14*d*, and 14*f*, until all but the last or lower flap 90*f* remains in the path of the bags 14, and the preselected number of bags 14 is received within the chute 30, as shown in FIG. 4*e*. Therefore, all the bags 14 have been received within the chute 30 and traveled along the path of travel without falling or sliding a continuous distance greater than their size.

Referring to FIG. 4*f*, the last or lowest flap 90*e* pivots or moves into the second pass position, releasing all of the bags 14 from the chute 30. It will be noted that as the bags accumulate in the chute 30, and as the flaps 90 pivot to the second pass position, that all the bags 14 entering the chute 30 fall roughly equivalent distances such that an upper surface of one of the bags 14 is always disposed generally at the same height as the first stop. Therefore, the plurality of spaced apart flaps 90 which sequentially lower or advance the bags 14 control the distance which the bags 14 move to prevent bruising or damage of the items in the bags 14.

Figure 5:
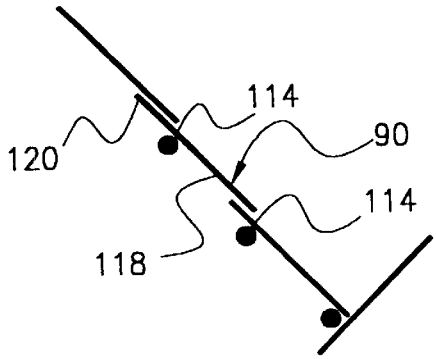
FIG. 5 is a schematic view of the preferred embodiment of the apparatus for bagging of potatoes into a baler bag of the present invention.

Referring to FIGS. 3 and 5, the flaps 90 preferably include a pivot axle 114 which defines a pivot axis about which the flaps 90 pivot. The pivot axle 114 extends transverse to the path of travel of the bags 14 and has opposing ends coupled to opposite sides 84 and 86 (FIG. 2) of the chute 30. The flaps 90 also have a primary flap portion 118 attached to and extending from the pivot axle 114 which pivots as the pivot axle 114 pivots. The primary flap portion 118 extends into the path of travel of the bags 14 when the flaps 90 are in a first stop position. The flaps 90 also have a secondary flap portion 120 attached to and extending from the pivot axle in an opposite direction to the primary flap portion 118. The primary flap portion 118 is sized to extend proximal to the next adjacent pivot axle 114 when in the second pass position. Thus, the flaps 90, or primary flap portion 118, form the bottom wall 82 of the chute 30 or a slide on which the bags 14 may slide. The secondary flap portion 120 extends under the prior adjacent flap when in the second pass position such that the flaps 90 overlap one another to prevent gaps where the bags 14 may catch and become lodged in the chute.

Figure 8:
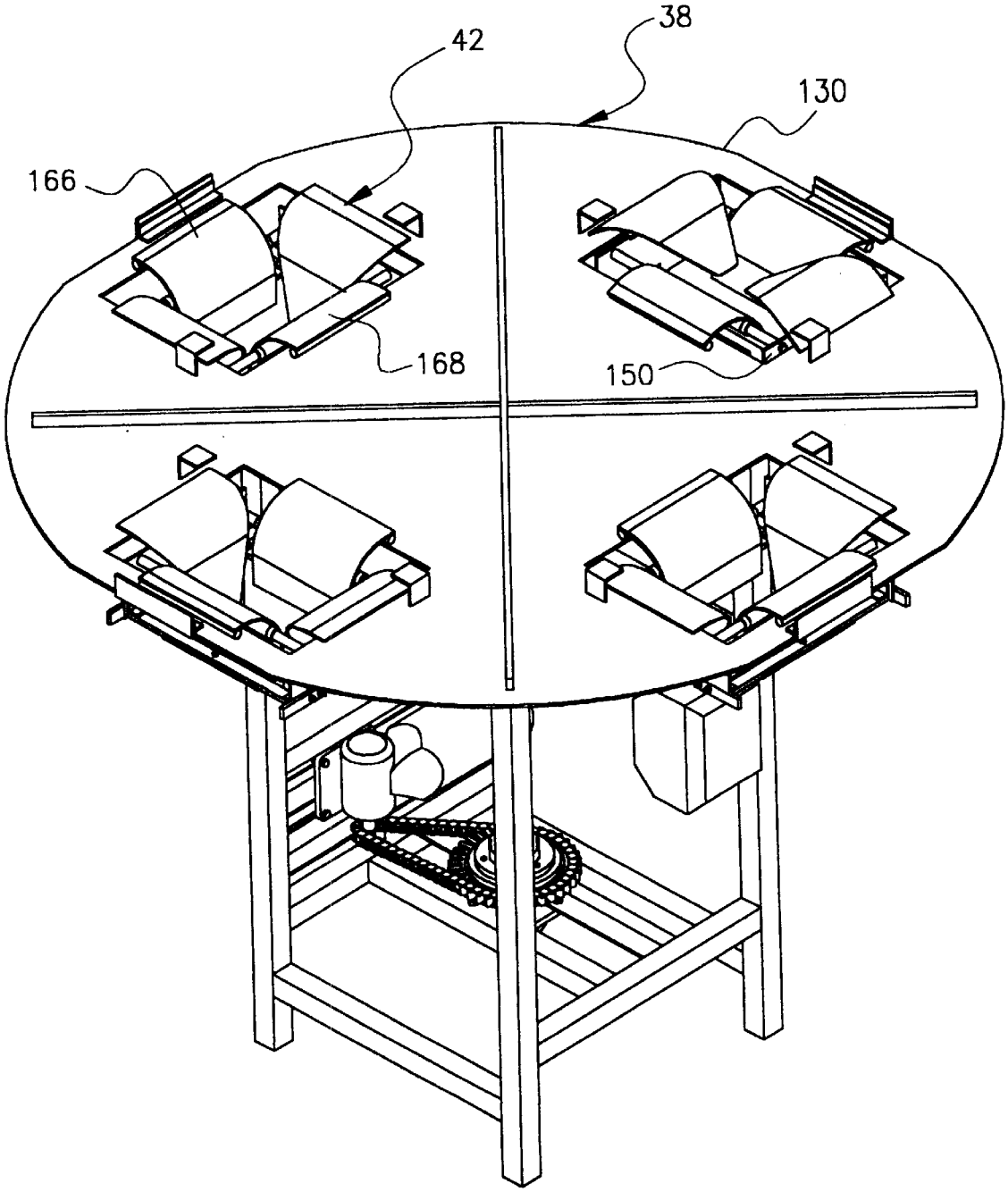
FIG. 8 is a perspective view of a preferred embodiment of an apparatus for supporting and positioning a baler bag of the present invention.

Therefore, the pivoting or moving flaps 90 present a significant advantage in the bagging of filled bags 14 into the baler bag 18, by sequentially lowering the bags 14 through a plurality of stages, stops, or steps each sized relative to the size of the filled bags 14 themselves in order to prevent bruising. Referring again to FIGS. 1 and 2, the baler bag handling apparatus 34 includes a baler bag rotating wheel 38 for positioning baler bags 18 beneath the chute 30. Referring now to FIG. 8, the baler bag wheel 38 includes a moving support frame 130. The plurality of baler bag heads 42 are disposed on the moving support frame 130. The moving frame 130 moves to sequentially position the baler bag heads 42 at the lower end of the chute 30. In addition, the moving frame 130 sequentially positions the baler bag heads 42 at a plurality of different stations, as discussed in greater detail below.

The moving frame 130 is preferably a table with a round rotatable top which rotates about a vertical axis of rotation with the baler bag heads 42 spaced radially from the axis of rotation about the circumference or perimeter of the table top. The table top includes a plurality of openings therein for receiving the baler bag heads 42. The moving support frame 130 may include a rigid support structure coupled to the ground between the table top and the ground. A vertical shaft may be coupled to the table top and rotatably coupled to the support structure. A motor is coupled by a chain and sprockets between the support structure and the axis for selectively rotating the table top, and thus the baler bag heads 42, in discrete increments.

Figure 6:
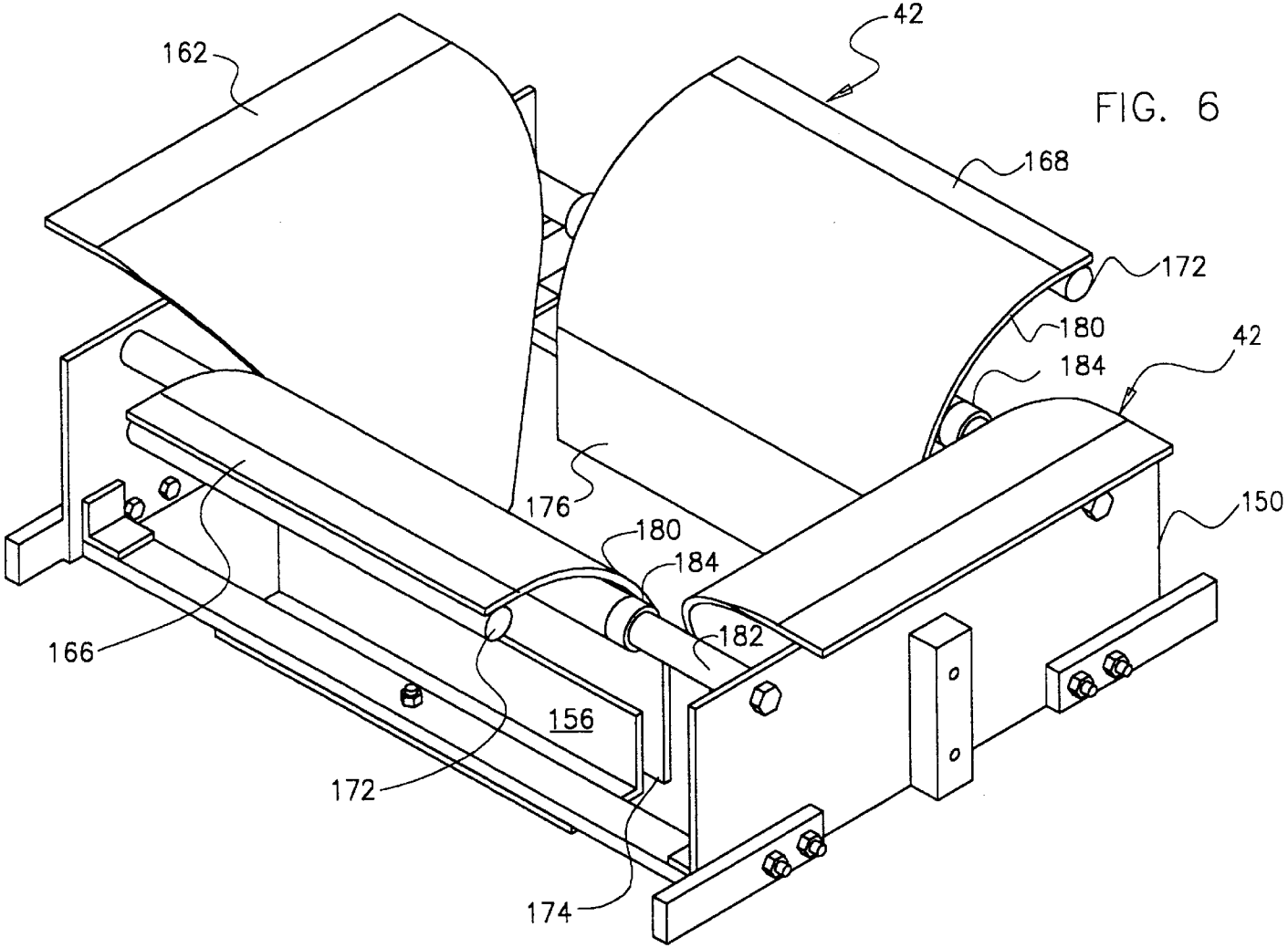
FIG. 6 is a perspective view of a preferred embodiment of an apparatus for supporting a baler bag of the present invention.
Figure 7:
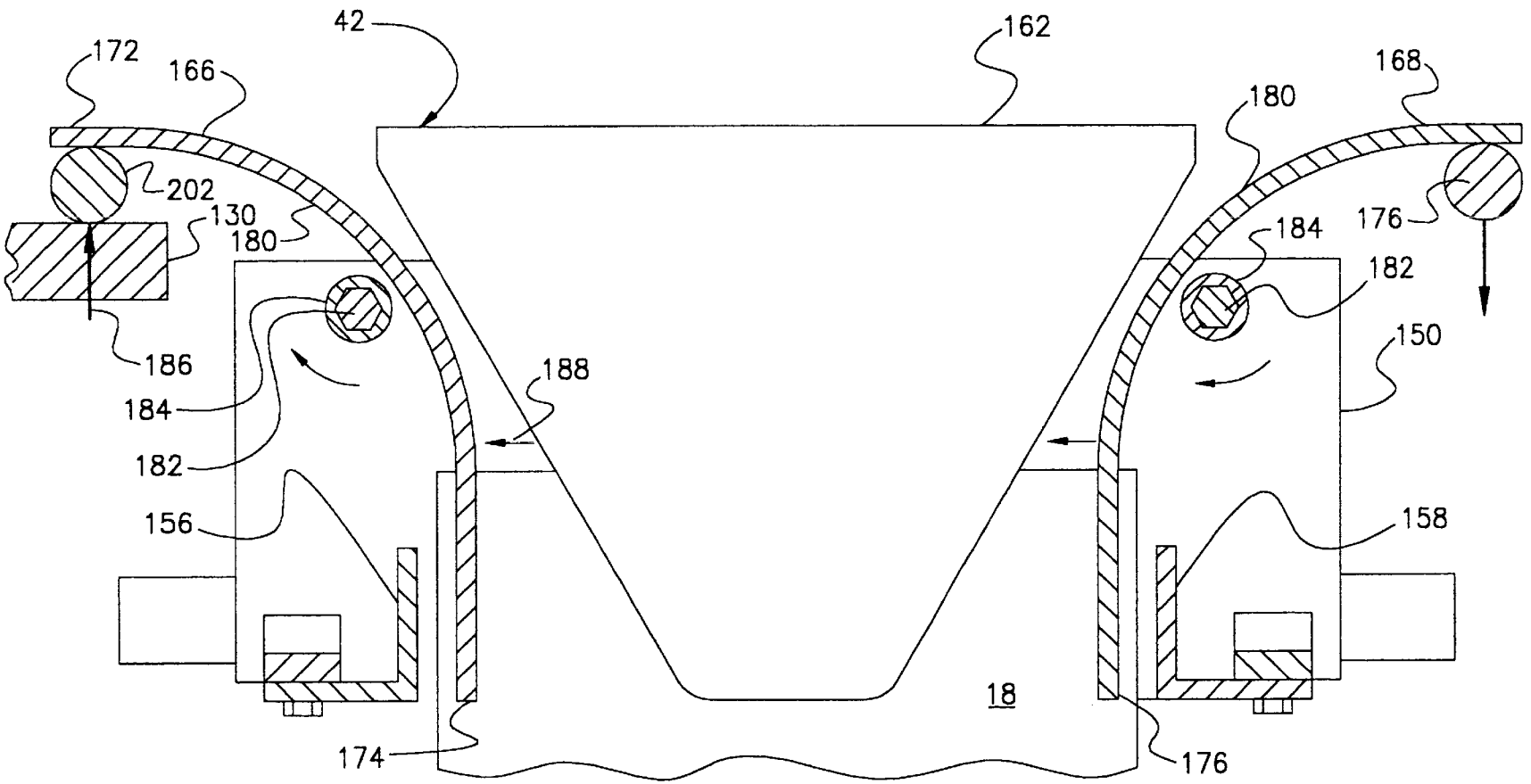
FIG. 7 is a side view of the preferred embodiment of the apparatus for supporting a baler bag of the present invention.

Referring to FIGS. 6 and 7, the baler bag heads 42 are shown in greater detail. The baler bag head 42 includes a collar 150 which is disposed on the support frame 130, as shown in FIG. 7. The collars 150 have a generally rectangular shape and are removably received within rectangular openings of the table top or support frame 130. The collars 150 define an opening through which the filled bags 14 pass into the baler bags 18. First and second lips 156 and 158 are coupled to or formed on the collar 150 and located at opposite sides of the opening.

A plurality of plate members 162 are coupled to the collar 150 around the opening and are oriented at an inclined angle, forming a funnel for guiding the bags 14 through the opening. Preferably, the plate members 162 are arcuate and surround the opening, and thus prevent the bags 14 from catching on the edges of the baler bags 18. As shown, there may be four plate members 162 each located on a side of the rectangular opening. The plate members 162 may taper or narrow as they extend into the opening and through the collar 150.

The plate members 162 include a plurality of pivot plate members, such as first and second pivot plate members 166 and 168. The first and second pivot plate members 166 and 168 are pivotally coupled to the collar 150 at opposite sides of the opening. The pivot plate members 166 and 168 have upper ends 172 and first and second lower ends 174 and 176, respectively. The pivot plate members 166 and 168 also have a middle portion 180 pivotally coupled to the collar 150. A pair of pivot axles 182 are coupled to the collar 150 and extend along opposite sides of the opening. The middle portions 180 include pivot collars 184 coupled thereto and pivotally coupled to the pivot axles 182. The first and second lower ends 174 and 176 of the pivot plate members 166 and 168 extend to locations opposite the first and second lips 156 and 158, respectively, such that the sides or ends of the baler bags 18 may be grasped between the first lip 156 and first lower end 174 of the first pivot plate 166. Similarly, an opposite side of the baler bag 18 may be grasped between the second lip 158 and second lower end 176 of the second pivot plate 168.

Preferably, the collars 150 removably engage the moving support frame 130 and move vertically up and down between a first upper position and a second lower position. The upper ends 172 of the pivoting plate members 166 and 168 engage the support frame 130 or upper surface of the table top such that the pivot plate members 166 and 168 pivot back and forth as the collar 150 moves up and down. The pivot plate members 166 and 168 pivot or move between a first open position and a second closed position. In a first open position, the lower ends 174 and 176 of the pivot plate members 166 and 168 pivot away from the lips, such that baler bags 18 may be removed and positioned between the lips 156 and 158 and the lower ends 174 and 176, as shown on the right side of FIG. 7. In the second closed position, the lower ends 174 and 176 of the pivot plate members 166 and 168 pivot towards the lips 156 and 158 such that a baler bag 18 is gripped between the lower ends 174 and 176 of the pivot plate members 166 and 168 and the lips 156 and 158, as shown on the left side of FIG. 7.

Preferably, the collar 150 is suspended from the support frame 130 by the pivoting plate members 166 and 168, as shown on the left side of FIG. 7 and FIG. 8. The upper ends 172 of the pivot plate members 166 and 168 extend beyond the opening in the table top support frame 130 such that the collar 150 is suspended in the openings from the upper ends 172 of the pivot plate members 166 and 168, as shown on the left side of FIG. 7. Thus, the pivot plate members 166 and 168 act as levers pivoting about the middle portion 180 with weight providing force against the upper ends 172 to close the lower ends 156 and 158. Therefore, the weight of the collar 150, plate members 162 and the bags 14 exert a force on the pivot members causing the pivot members 166 and 168 to pivot to the second closed position. For example, because the collar is suspended from the support frame 130 by hanging from the upper ends 172 of the pivot plate members 166 and 168, the weight of the collar 150 itself and the weight of the bags 14 and the baler bag 18 exert a downward force on the collar 150, and thus an upward force on the upper ends 172 of the pivot plate members 166 and 168, as represented by arrow 186. The force 186 exerted on the upper ends 172 of the pivot plate members 166 and 168 causes the lower ends 174 and 176 of the pivot plates to exert a force against the lips 156 and 158, respectively, as indicated by arrow 188. The force 188 of the lower ends 174 and 176 grasps the upper end of the baler bag 18 between the lower ends 174 and 176 and lips 156 and 158, respectively. Thus, the weight of the baler bag 18 itself helps the baler bag head 42 grasp the baler bag.

The upper ends 172 of the pivot plate members 166 and 168 are weighed with weights 202 such that the pivot plate members 166 and 168 pivot to the first open position as the collar 150 moves to the first upper position, as shown on the right side of FIG. 7. Thus, the pivoting plate members 166 and 168 are biased towards the first open position and pivot out of the opening as the collar 150 moves upwardly.

It is of course understood that all of the plate members 162 may pivot on the collar 150 to receive a baler bag.

Figure 10:
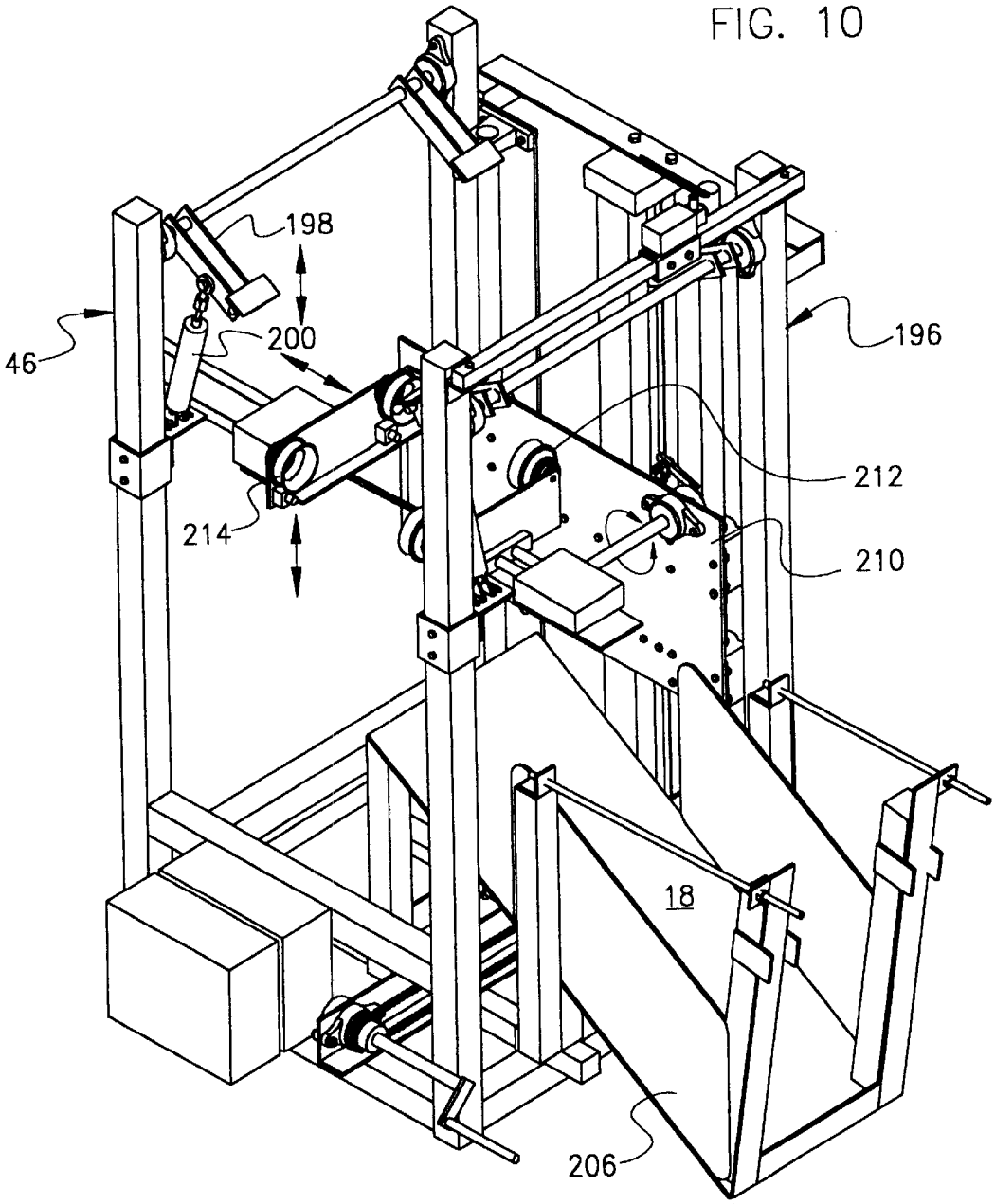
FIG. 10 is a perspective view of a preferred embodiment of an apparatus for positioning and opening a baler bag of the present invention.

As indicated above, the moving frame 130 sequentially positions the baler bag heads 42 at a plurality of different stations. The stations include a first baler bag hanging station, indicated generally at 196 in FIG. 2, where baler bags 18 are hung from the baler bag heads 42. Referring to FIG. 10, a baler bag hanging mechanism or baler bag in-feed 46 is located at the first baler bag hanging station. The baler bag in-feed 46 positions the upper ends of the baler bags 18 at the baler bag heads 42 for being grasped by the baler bag heads 42. The baler bag in-feed 46 includes arms 198 which are pivoted by actuators 200 to lift the baler bag heads 42 or the collars 150 from the support frame 130, thus, positioning the pivoting plate members 166 and 168 in the first open position. Baler bags 18 are disposed in an angled baler bag platform 206. A vertical lift mechanism 210 moves vertically between the baler bag platform 206 and the baler bag heads 42. The vertical lift mechanism 210 includes opposing suction mechanisms for engaging and holding the baler bags 18 including a pivoting suction mechanism 212 which pivots to engage a baler bag 18 and lift it from the platform 206. The opposing suction mechanisms 212 and 214 engage opposite sides of the baler bag 18 by creating a suction between suction cups and the baler bag 18. The opposing vacuum mechanisms 212 and 214 then separate or move away from each other to open the baler bag. The vertical lift mechanism 210 raises vertically, lifting the vacuum mechanisms 212 and 214 and a baler bag 18 upwardly towards the head 42. Thus, the baler bag in-feed 46 engages a baler bag 18, lifts the baler bag vertically from a platform 206 to a baler bag head 42, orients the baler bag in a vertical orientation, and opens the baler bag to receive the bags 14.

The plurality of stations also include a second baler bag filling station, indicated generally at 228 in FIG. 1, where the baler bag heads 42 are located beneath the chute 30 for receiving the bags 14 from the chute 30.

Figure 9:
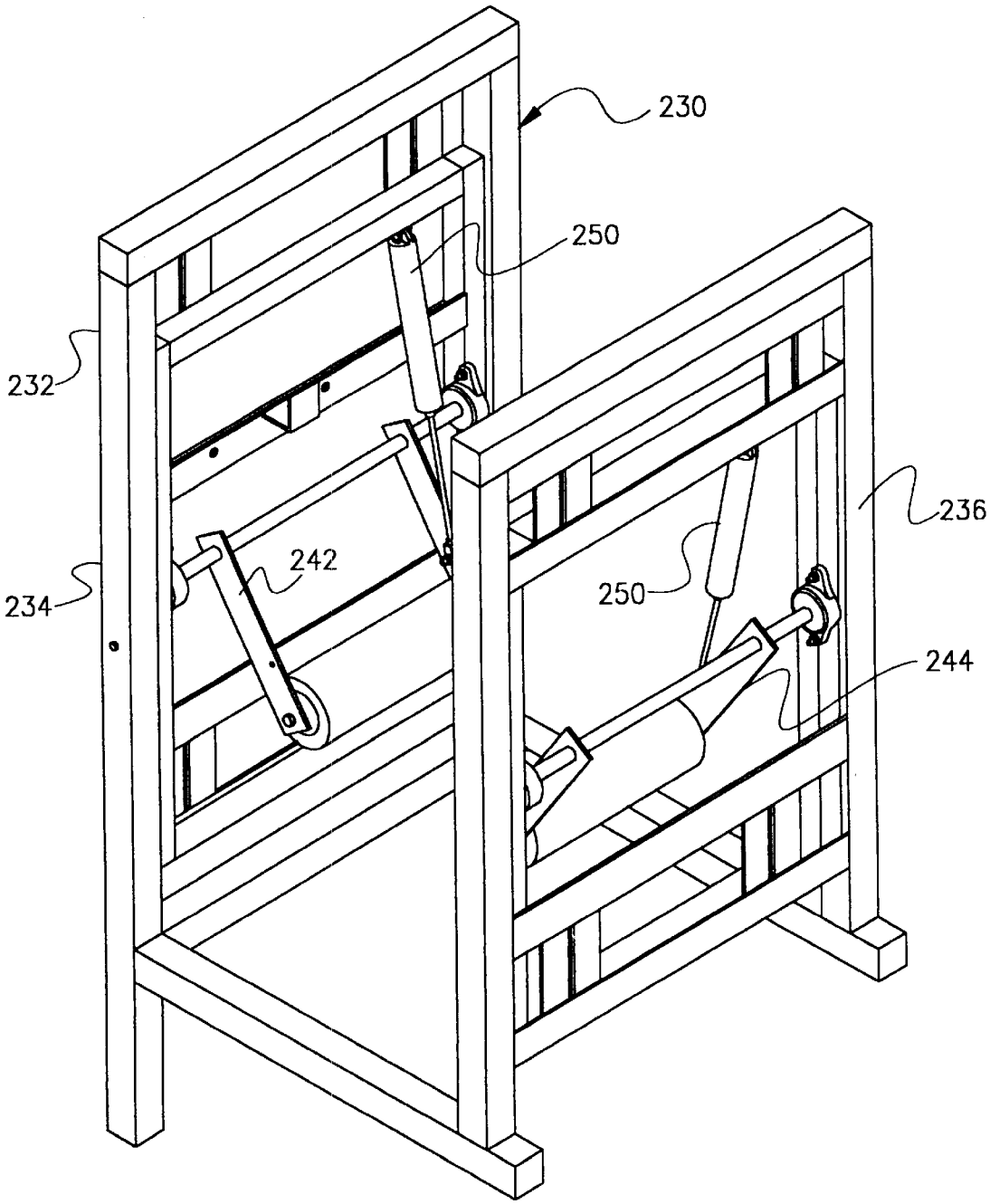
FIG. 9 is a perspective view of a preferred embodiment of an lower mechanism for lowering filled bags in the baler bags of the present invention.

Referring to FIG. 9, a lowering mechanism 230 is located in the second baler bag filling station beneath the chute 30. The lowering mechanism 230 includes a U-shaped frame having upright extending and spaced apart frame portions 234 and 236 defining an open interior therebetween. As the support frame 130 of the baler bag conveyer 38 rotates, baler bags 18 rotate between the upward extending portions 234 and 236 under the chute 30. Opposing and pivoting arms 242 and 244 are pivotally coupled to the upper extending portions 234 and 236, respectively, with the baler bag 18 disposed between the pivoting arms 242 and 244. Actuators 250 pivot the pivoting arms 242 and 244 vertically. After the baler bag 18 enters the lowering mechanism 230, the pivoting arms 242 and 244 are raised with the baler bag 18 therebetween, such that the bags 14 fall from the chute 30 and into the bailer bag 18, but only to the pivoting arms 242 and 244, as opposed to falling to the bottom of the baler bag 18, thus preventing the bags 14 from impacting and tearing open the bottom of the baler bag 18. The actuators 250 slowly lower the pivoting arms 242 and 244, and thus slowly lower the bags 14 within the baler bag 18.

The stations include a third removing station, indicated generally at 268 in FIG. 1, where the baler bags 18 are removed from the baler bag heads 42 and the baler bag conveyer 38. The third station includes the take-away conveyer 50 which conveys baler bags 18 away from the baler bag conveyer 38. Referring to FIGS. 1 and 2, the take-away conveyer 50 includes a first horizontally-oriented conveyer 270 on which the baler bags 18 are disposed. The first horizontal conveyer 270 has a first end located proximal to the third baler bag removing station of the baler bag conveyer 38. The horizontal conveyer 270 has a first horizontal surface for receiving the baler bags 18. In addition, the take-away conveyer 50 includes a second vertically oriented conveyer 280 extending alongside the first conveyer 270. The second vertical conveyer 280 has a plurality of spaced apart partitions 282 which extend from the conveyer 280, creating a space therebetween for receiving the baler bag 18. A vertically oriented wall 290 extends along the length of the first conveyer at a spaced apart relationship from the second vertical conveyer 280. The partitions 282, vertical conveyer 280 and vertical wall 290 maintain the baler bags 18 in a vertical orientation.

A method for using the apparatus 10 of the present invention. includes first elevating the plurality of bags 14 to a predetermined height using the in-feed conveyer 22. Preferably, the bags 14 are separated from one another using a speed-up conveyer 26. The bags 14 are then sequentially lowered along a path of travel through a series of discrete stages, each having a distance sized to prevent bruising, using the chute 30 with the plurality of movable flaps 90 spaced along the length of the chute 30 and defining the stages. The bags 14 may be lowered vertically or along a vertical incline.

A first bag 14*a* may be lowered into the chute 30 and to a first stage or stop, defined by the first flap 90*a*. The first bag 14*a* is then lowered to a second stage or stop, defined by a second flap 90*b*. A second bag 14*b* is then lowered into the chute and onto the first bag 14*a*. The upper surface of the first bag 14*a*, while the first bag is disposed on the second flap 90*b*, is disposed substantially at the same elevational height as the first flap 90*a* in the first stop position. Therefore, the second bag 14*b*, although being lowered onto the first bag 14*a*, is lowered the same vertical distance as the first bag. The first and second bags 14*a* and 14*b* are then lowered to the third stage or stop, defined by a third flap 90*c*.

A baler bag 18 is positioned below the bags 14 or below the chute 30 and open to receive the bags 14 from the chute 30. Preferably, the baler bag is opened, positioned, and supported on a baler bag head 42 while the bags 14 are simultaneously lowered in the chute 30. In addition, the baler bag 18 is preferably opened, positioned, and supported on a baler bag head 42 while the bags 14 are simultaneously lowered in the chute 30. In addition, the baler bag 18 is preferably opened, positioned, and supported on a baler bag head 42 at a location different from a location beneath the chute 30. Thus, while a first baler bag is being filled from the chute, a second baler bag may be opened, positioned, and prepared. Once a baler bag is positioned beneath the chute, the bags 14 are lowered into the baler bag.

As indicated above, a pair of opposing pivot arms 242 and 244 of the lowering mechanism 230 may be in a raised position with the baler bag therebetween, forming an intermediate stop above the bottom of the baler bag such that the bags 14 fall from the chute 30 into the baler bag and to the pivoting arms 242 and 244. The pivoting arms 242 and 244 then lower, allowing the bags 14 to continue to the bottom of the baler bag. The baler bag 18 preferably is then moved from a location beneath the chute while a second baler bag which has been previously opened and supported on a different baler bag head 42, is simultaneously positioned under the chute. The filled baler bag is then removed from the baler bag conveyer 38 by the take-away conveyer 50.

As indicated above, the apparatus may be configured to bag the plurality of filled bags 14 into larger boxes, as opposed to the baler bags 18. Thus, the baler bag handling apparatus 34 may be configured to handle boxes, including a rotating wheel configured for positioning boxes beneath the chute 30.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for bagging a plurality of filled bags into a larger baler bag, the apparatus comprising:

a chute for receiving the filled bags and defining a path of travel for the filled bags, the chute having an upper end configured for receiving the filled bags into the chute, and an opposite lower end disposed at a lower elevation than the upper end and configured for releasing the filled bags from the chute; and a plurality of flaps movably coupled to the chute at spaced apart locations along the length of the chute defining a plurality of sequential stops, each of the plurality of flaps moving between (i) a first stop position in which the flaps extend transversely to the chute and into the path of travel of the filled bags to stop the filled bags from continued travel along the chute, and (ii) a second pass position in which the flaps extend out of the path of travel of the filled bags to allow the filled bags to continue traveling along the chute, the plurality of flaps sequentially moving in sequential order from the upper end to the lower end of the chute from the first stop position to the second pass position, such that the filled bags are sequentially lowered from one flap to another; and the plurality of flaps including a first upper flap located closer to the upper end of the chute than remaining flaps and defining a first stop at a first height; and the plurality of flaps being spaced apart distances approximately equal to a size of the filled bags such that an upper surface of an upper filled bag is disposed at approximately a same height as the first stop such that the filled bags entering the chute fall approximately a same distance from the upper end of the chute to the first stop or upper surface of the upper filled bag; and the plurality of flaps each including:

a pivot axle extending transverse to the path of travel of the filled bags and defining a pivot axis about which the flap pivots, the pivot axle having opposing ends each of which is pivotally coupled to opposing sides of the chute;

a primary flap portion attached to and extending from the pivot axle and pivoting as the pivot axle pivots, the primary flap portion extending into the path of travel of the filled bags in the first stop position; and a secondary flap portion attached to and extending from the pivot axle in a direction opposite to the primary flap portion and pivoting as the pivot axle pivots.

2. The apparatus of claim 1, wherein the plurality of flaps divide the chute into a plurality of individual compartments, and wherein the plurality of flaps are spaced apart a distance such that each of the individual compartments are sized to receive one of the filled bags.

3. The apparatus of claim 1, wherein the plurality of flaps are pivotally coupled to the chute and pivot between the first stop position and the second pass position.

4. The apparatus of claim 1, wherein the chute has a chute wall defining a hollow interior through which the bags of potatoes pass, and wherein the plurality of flaps form a vertically inclined slide when in the second pass position along which the filled bags slide.

5. The apparatus of claim 1, further comprising:

a sensor located proximal to the upper end of the chute and configured for sensing the filled bags entering the chute, the sensor producing a sensor signal;

a controller responsive to the sensor signal and producing a control signal; and a plurality of actuators each coupled to a different flap and responsive to the control signal to move the flap.

6. The apparatus of claim 1, further comprising:

a support frame, located at the lower end of the chute;

a collar, movably engaging the support frame and located proximal to the lower end of the chute, the collar defining an opening through which the filled bags pass into the baler bag, the collar including first and second lips located at opposite sides of the opening;

a plurality of pivoting plate members pivotally coupled to the collar at opposite sides of the opening and having upper ends, opposite lower ends, and middle portions between the upper and lower ends pivotally coupled to the collar, each of the lower ends of the pivot members extending to different locations opposing the lips, such that opposite sides of the baler bag may be grasped between the lips and lower ends of the pivoting plate members, the upper ends of the pivoting plate members engaging the support frame such that the pivoting plate members pivot as the collar moves between (i) a first open position in which the lower ends of the pivoting plate members pivot away from the lips to remove and position baler bags between the lips and lower ends, and (ii) a second closed position in which the lower ends of the pivoting plate members pivot towards the lips to grip the baler bags between the lower ends of the pivot members and the lips.

7. The apparatus of claim 6, wherein the collar is suspended from the support frame by the pivoting plate members such that the weight of the collar and filled bags exerts a force on the pivoting plate members causing the pivoting plate members to pivot to the second closed position.

8. The apparatus of claim 6, wherein the pivoting plate members are disposed at an inclined angle for guiding the filled bags through the opening.

9. The apparatus of claim 6, wherein the support frame is a moving frame having a plurality of collars with pivoting plate members disposed thereon, the moving frame moving to sequentially position the collars at a plurality of different stations including:

a first baler bag hanging station for hanging baler bags from the collars and including a bag hanging mechanism for positioning the upper end of the baler bags at the collars for being grasped by the collar and pivoting plate members, a second baler bag filling station located beneath the chute for receiving the bags of potatoes from the chute, and a third baler bag removing station where the baler bags are removed from the collars.

10. The apparatus of claim 1, wherein the plurality of flaps including a first upper flap located closer to the upper end of the chute than the remaining flaps and defining a first stop at a first height; and the plurality of flaps being spaced apart a distance approximately equal to the size of the filled bags such that an upper surface of an upper filled bag is disposed at approximately the same height as the first stop such that the filled bags entering the chute fall approximately the same distance from the upper end of the chute to the first stop or upper surface of the upper filled bag.

11. An apparatus for bagging a plurality of bags of potatoes into a baler bag, the apparatus comprising:

a vertically inclined chute for receiving the bags of potatoes and defining a vertically inclined path of travel for the bags of potatoes, the chute having an open upper end located at the elevated position configured for receiving the bags of potatoes from the conveyor, and an opposite lower end disposed at a lower elevation than the upper end; and a plurality of flaps pivotally coupled to the chute at spaced apart locations along the length of the chute defining a plurality of sequential vertical stops and dividing the chute into a plurality of individual compartments sized to receive at least one of the bags of potatoes, each of the plurality of flaps pivoting between (i) a first stop position in which the flaps extend transversely to the chute and into the path of travel of the bags of potatoes to stop the bags of potatoes from continued travel along the chute, and (ii) a second pass position in which the flaps extend generally parallel to the chute and the path of travel of the bags of potatoes to allow the bags of potatoes to continue traveling along the chute, the plurality of flaps sequentially pivoting in order from the upper end to the lower end of the chute from the first stop position to the second pass position, each flap pivoting from the first stop position to the second pass position after receiving at least one of the bags of potatoes to lower the bags of potatoes to the next lower flap, such that the bags of potatoes are sequentially lowered from one flap to another; and the plurality of flaps including a first upper flap located closer to the upper end of the chute than the remaining flaps and defining a first stop at a first height; and the plurality of flaps being spaced apart at distances approximately equal to a size of one to two of the bags of potatoes such that an upper surface of an upper bag of potatoes is disposed generally at the same height as the first height of the first stop such that the bags of potatoes entering the chute generally fall the same distance from the upper end of the chute to the first stop or upper surface of the upper bag of potatoes; and the plurality of flaps each including:

a pivot axle extending transverse to the path of travel of the bags of potatoes and defining a pivot axis about which the flap pivots, the pivot axle having opposing ends each of which is pivotally coupled to opposing sides of the chute;

a primary flap portion attached to and extending from the pivot axle and pivoting as the pivot axle pivots, the primary flap portion extending into the path of travel of the bags of potatoes in the first stop position; and a secondary flap portion attached to and extending from the pivot axle in a direction opposite to the primary flap portion and pivoting as the pivot axle pivots.

12. The apparatus of claim 11, further comprising:

a sensor located proximal to the upper end of the chute and configured for sensing the bags of potatoes entering the chute, the sensor producing a sensor signal;

a controller responsive to the sensor signal and producing a control signal; and a plurality of actuators each coupled to a different flap and responsive to the control signal to move the flap.

13. The apparatus of claim 11, further comprising a baler bag head located proximal to the lower end of the chute for supporting the baler bag in an open configuration for receiving the bags of potatoes from the chute, the baler bag head comprising:

a support frame located at the second end of the chute;

a collar movably attached to the support frame and located proximal to the second end of the chute, the collar defining an opening through which the bags of potatoes pass into the baler bag, the collar moving generally vertically with respect to the frame between a first upper position and a second lower position, the collar including first and second lips located at opposite sides of the opening;

a plurality of plate members coupled to the collar around the opening at an inclined angle forming a funnel configured for guiding the bags of potatoes through the opening, the plurality of plate members including first and second pivoting plate members pivotally coupled to the collar at opposite sides of the opening, the first and second pivoting plate members having an upper end and first and second lower ends, respectively, the pivoting plate members also having a middle portion between the upper and lower ends and pivotally coupled to the collar, the first and second lower ends of the pivoting plate members extending to locations opposing the first and second lips, respectively, such that opposite sides of the baler bag may be grasped between the first lip and first lower end of the first pivoting plate member, and the second lip and second lower end of the second pivoting plate member, the upper ends of the pivoting plate members engaging the support frame such that the pivoting plate members pivot as the collar moves between (i) a first open position when the collar is in the upper position and in which the lower ends of the pivot members pivot away from the lips to remove and position the baler bags between the lips and lower ends, and (ii) a second closed position when the collar is in the lower position and in which the lower ends of the pivot members pivot towards the lips to grip the baler bags between the lower ends of the pivot members and the lips.

14. The apparatus of claim 13, wherein the collar is suspended from the support frame by the pivot members such that the weight of the collar and bags of potatoes exerts a force on the pivot members causing the pivot members to pivot to the second closed position.

15. The apparatus of claim 13, wherein the support frame positions baler bags at a location beneath the chute and further comprises:

a moving frame having a plurality of baler bag heads disposed thereon, the moving frame moving to sequentially position the baler bag heads at the lower end of the chute, and sequentially positioning the baler bag heads at a plurality of different stations including:

a first baler bag hanging station for hanging baler bags from the baler bag heads and including a bag hanging mechanism for positioning the upper end of the baler bags at the baler bag heads for being grasped by the baler bag heads, a second baler bag filling station located beneath the chute for receiving the bags of potatoes from the chute, and a third baler bag removing station where the baler bags are removed from the baler bag heads.

16. The apparatus of claim 11, wherein the flaps extend perpendicularly with respect to the chute in the first stop position.

17. The apparatus of claim 11, wherein the flaps extend perpendicularly with respect to the chute in the first stop position.

* * * * *